US012528626B2

(12) United States Patent
Thieman

(10) Patent No.: US 12,528,626 B2
(45) Date of Patent: Jan. 20, 2026

(54) CONTAINER HAVING ADJUSTABLE OPENING LID

(71) Applicant: Scott T. Thieman, Fort Collins, CO (US)

(72) Inventor: Scott T. Thieman, Fort Collins, CO (US)

( * ) Notice: Subject to any disclaimer, the term of this patent is extended or adjusted under 35 U.S.C. 154(b) by 120 days.

(21) Appl. No.: 18/612,820

(22) Filed: Mar. 21, 2024

(65) Prior Publication Data

US 2024/0239568 A1 Jul. 18, 2024

Related U.S. Application Data

(63) Continuation of application No. PCT/US2022/044576, filed on Sep. 23, 2022.

(60) Provisional application No. 63/248,435, filed on Sep. 25, 2021.

(51) Int. Cl.
*B65D 47/26* (2006.01)
*B65D 45/30* (2006.01)

(52) U.S. Cl.
CPC ..... *B65D 47/265* (2013.01); *B65D 45/30* (2013.01)

(58) Field of Classification Search
CPC ..... B65D 47/265; B65D 45/30
USPC ..... 220/253
See application file for complete search history.

(56) References Cited

U.S. PATENT DOCUMENTS

| | | | | |
|---|---|---|---|---|
| 3,924,772 | A * | 12/1975 | Magnani | B65D 51/145 215/354 |
| 4,190,173 | A * | 2/1980 | Mason | A47J 41/0027 222/548 |
| 10,661,952 | B2 * | 5/2020 | Coffey | B65D 51/1688 |
| 11,453,533 | B2 | 9/2022 | Zhang | |
| 2012/0187124 | A1 | 7/2012 | Chang | |
| 2015/0060450 | A1 | 3/2015 | Phillips | |
| 2018/0037382 | A1 | 2/2018 | Huss | |
| 2020/0165041 | A1 | 5/2020 | Bottger | |
| 2024/0239568 | A1 * | 7/2024 | Thieman | B65D 45/30 |

FOREIGN PATENT DOCUMENTS

CN 213922251 U 8/2021

* cited by examiner

*Primary Examiner* — Paul R Durand
*Assistant Examiner* — Randall A Gruby
(74) *Attorney, Agent, or Firm* — Samuel M. Freund; Cochran Freund & Young LLC

(57) ABSTRACT

A container, including a jar having an open end and screw threads on its outer surface near the open end thereof, a ring adapted to screw onto the screw threads for securing an adjustable opening lid, wherein many pouring and dispensing options for materials disposed in the container are possible, including the use of an implement to remove contents therein, is described. The jar member may comprise a Mason jar, as an example, and can be resealed between uses and refilled as required.

22 Claims, 7 Drawing Sheets

CONTAINER HAVING ADJUSTABLE OPENING LID

CROSS-REFERENCE TO RELATED APPLICATIONS

The present application is a continuation of PCT Patent Application No. PCT/US2022/044576 for "Container Having Adjustable Opening Lid" which was filed 23 Sep. 2022, and which claims the benefit of U.S. Provisional Patent Application No. 63/248,435 for "Container Having Adjustable Opening Lid" which was filed on 25 Sep. 2021, the entire contents of said Patent Applications being hereby specifically incorporated by reference herein for all that they disclose and teach.

BACKGROUND

Containers having integrally disposed dispensing caps are widely employed for controllably distributing materials held in the container, without having to remove the cap from the container to achieve this function. For disposable containers, the dispensing cap may initially provide a seal, which when broken or otherwise irreversibly opened, provides an opening the size of which may be adjusted with the help of a movable covering element, itself having openings of different sizes. Since, once opened, the container cannot be resealed without the use of additional materials, such as aluminum foil or plastic wrapping material, the container contents are generally quickly consumed to avoid spoilage. Moreover, the container cannot easily be refilled. Additionally, the movable covering element, which may be constructed from inexpensive plastic materials, is fragile, and can be damaged as a result of introducing metal implements, such as spoons, into larger openings to remove the contents of the container.

SUMMARY

In accordance with the purposes of the present invention, as embodied and broadly described herein, an embodiment of the container having an adjustable opening, hereof, includes: a jar having a flat circular open mouth and an outer surface having a screw thread near the flat open mouth; a circular ring having an open circular flat rim with a chosen inner diameter, and a screw thread adapted to screw onto the screw thread of the jar; a disk-shaped lid, including: a first flat circular plate having a first axis, a first surface and a second surface, an outer diameter such that the first circular plate is held between the flat open mouth of the jar and the flat rim of the ring, and a first chosen pattern formed therethrough inside the outer diameter thereof and outside of the first axis; a second flat circular plate having a second axis colinear with the first axis of the first circular plate, a first surface and a second surface, a second outer diameter effective for permitting a portion of the first surface of the second circular plate to cover all or a portion of the first chosen pattern of the first circular plate and smaller than the inner diameter of the flat rim of the circular lid, and a second chosen pattern formed therethrough inside the second outer diameter; and a tension spring having a first end and a second end, the first end thereof being formed with or attached to the second surface of the second circular plate and formed into a raised structure above the second surface; and means for attaching the second circular plate to the first circular plate such that the first surface of the first circular plate is in rotatable contact with the first surface of the second circular plate about the second axis, and the tension spring provides adjustable pressure between the second circular plate and the first circular plate and a handle for rotating the second circular plate.

In further accordance with the purposes of the present invention, as embodied and broadly described herein, another embodiment of the container having an adjustable opening, hereof, includes: a jar having a flat circular open mouth and an outer surface having a screw thread near the flat open mouth; a circular ring having an open circular flat rim with a chosen inner diameter, and a screw thread adapted to screw onto the screw thread of the jar; a disk-shaped lid, including: a first flat circular plate having a first axis, a first surface and a second surface, an outer diameter such that the first circular plate is disposed adjacent to the flat rim of the ring, and a first chosen pattern formed therethrough inside the outer diameter thereof and outside of the first axis; a second flat circular plate having a second axis colinear with the first axis of the first circular plate, a first surface and a second surface, a second outer diameter effective for permitting a portion of the first surface of the second circular plate to cover all or a portion of the first chosen pattern of the first circular plate and smaller than the inner diameter of the flat rim of the circular lid, and a second chosen pattern formed therethrough inside the second outer diameter; and a tension spring having a first end and a second end, the first end thereof being formed with or attached to the second surface of the second circular plate and formed into a raised structure above the second surface; a circular sealing lid having a first surface, a second surface, an outer diameter, and a flat gasket attached to or otherwise disposed on the second surface, the circular sealing lid being held between the first flat circular plate and the flat open mouth of the jar, forming an air-tight seal with the flat circular open mouth of the jar; and means for attaching the second circular plate to the first circular plate such that the first surface of the first circular plate is in rotatable contact with the first surface of the second circular plate about the second axis, and the tension spring provides adjustable pressure between the second circular plate and the first circular plate and a handle for rotating the second circular plate.

In yet further accordance with the purposes of the present invention, as embodied and broadly described herein, another embodiment of the disk-shaped lid having an adjustable opening, hereof, includes: a first flat circular plate having a first axis, a first surface and a second surface, an outer diameter, and a first chosen pattern formed therethrough inside the outer diameter thereof and outside of the first axis; a second flat plate having a first surface and a second surface for permitting a portion of the first surface of said second circular plate to cover all or a portion of the first chosen pattern of the first circular plate, and a second chosen pattern formed therethrough; and a tension spring having a first end and a second end, the first end thereof being formed with or attached to the second surface of the second plate and formed into a raised structure above the second surface; and means for attaching the second plate to the first circular plate such that the first surface of the first circular plate is in rotatable contact with the first surface of the second plate, and the tension spring provides adjustable pressure between said second plate and the first circular plate, and a handle for rotating said second plate.

Benefits and advantages of the present invention include, but are not limited to, providing a container, including a jar having an open end and screw threads on its outer surface near the open end thereof, a ring adapted to screw onto the screw threads for securing an adjustable opening lid, wherein many pouring and dispensing options for materials placed in the container are possible. Additionally, the container can be sealed between uses, and refilled as needed.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings:

FIG. 5E showing the removal of a portion of the smaller circular plate instead of a pattern formed therethrough.

DETAILED DESCRIPTION

Briefly, embodiments of the present invention include a container, comprising a glass jar having an open end and screw threads on its outer surface near the open end thereof, and a ring adapted to screw onto the screw threads for securing an adjustable opening lid, wherein many pouring and dispensing options for materials placed in the container are possible, including the use of an implement to remove contents therein. In accordance with the teachings of embodiments of the invention, the container can be purchased with its contents sealed against contamination and spoilage. Moreover, the container can be resealed after use as well as refilled.

Figure 1:
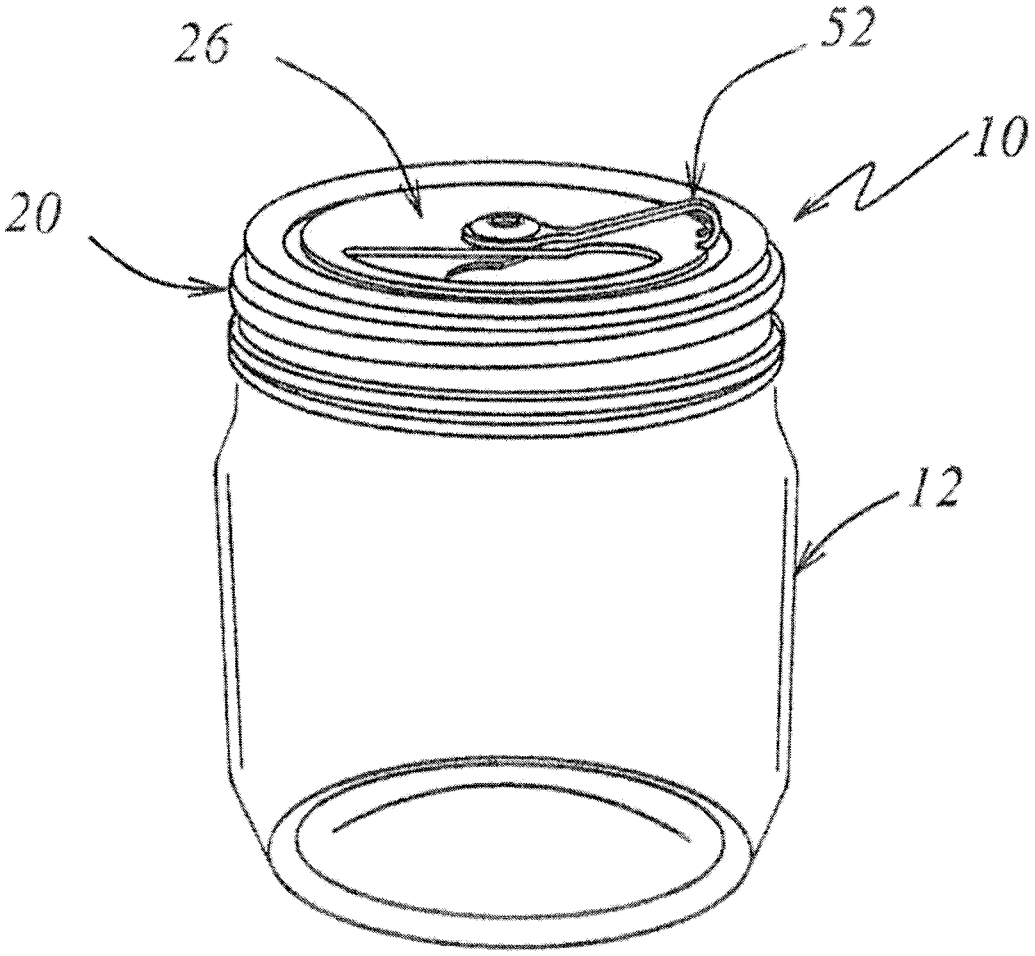
FIG. 1 is a schematic representation of a top perspective view of an embodiment of the assembled container having an adjustable opening lid hereof.
Figure 2B:
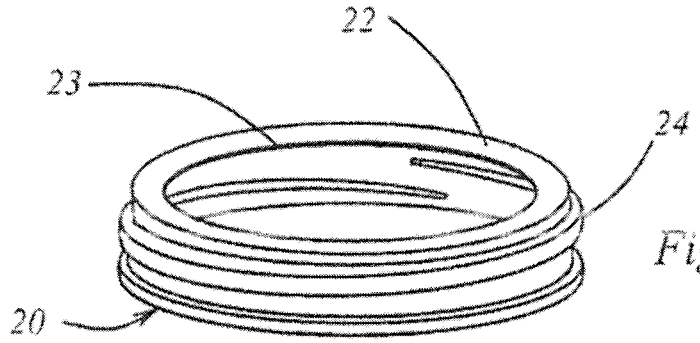
FIG. 2B is a schematic representation of a top perspective view of a circular ring or band having an open circular flat rim, and screw thread adapted to screw onto the screw thread of the jar member.

Reference will now be made in detail to the present embodiments of the invention, examples of which are illustrated in the accompanying drawings. In the FIGURES, similar structure will be identified using identical reference characters. It will be understood that the FIGURES are presented for the purpose of describing particular embodiments of the invention and are not intended to limit the invention thereto. Turning now to FIG. 1, shown is a schematic representation of a top perspective view of an assembled embodiment of container, 10, having an adjustable opening. FIG. 2A shows jar, 12, having flat circular open mouth, 14, and outer surface, 16, having screw thread, 18, near flat open mouth 14. Jar 12 may be a glass Mason jar, as an example. FIG. 2B illustrates circular ring or band, 20, having inwardly-directed, open circular flat rim, 22, with chosen inner diameter, 23, and screw thread, 24, adapted to screw onto screw thread 18 of jar 12. Disk-shaped lid, 26, shown in FIG. 2C, includes first flat circular plate, 28 (FIG. 2C(a)), having first axis, 30, passing through the center thereof, first surface, 32, and second surface, 34, outer diameter, 36, such that first circular plate 28 is fixed between flat open mouth 14 of jar 12 and flat rim 22 of ring 20, when circular gasketed sealing lid, 37, described in FIG. 2F, below, is not in use, and first chosen pattern, 38, formed therethrough inside the outer diameter thereof and outside of the first axis. Also shown in FIG. 2C is second flat circular plate, 40 (FIG. 2C(b)), having second axis, 42, passing through the center thereof and colinear with first axis 30 of first circular plate 28, first surface, 44, and second surface, 46, outer diameter, 48, effective for permitting a portion of first surface 44 of second circular plate 40 to partially overlap with or to cover first chosen pattern 38 of first circular plate 28 and smaller than inner diameter 23 of rim 22 of circular lid 20, and second chosen pattern, 50, formed therethrough inside outer diameter 48. It should be mentioned that second rotating plate 40 need not be circular to accomplish the above-described functions, as will be illustrated in FIG. 5E, below.

Tension spring or strip, 52, having first end, 54, and second end, 56, first end 54 thereof is formed with or attached to second surface 46 of second circular plate 40 and formed or bent into a raised structure above the second surface, thereby providing handle, 57, for rotating circular plate 40 relative to circular plate 28. Machine screw, 58, which is adapted to pass through hole, 60, in tension spring 52, hole, 62, in circular plate 40, and hole, 64, in circular plate 28, and engage with nut, 66, is illustrated in FIGS. 2C(b) and 2C(a), respectively, and illustrates one embodiment for attaching the smaller member 40 to the larger member 28 in an adjustable manner. FIG. 2D is a schematic representation of a side view of the disk-shaped lid of FIG. 2C, hereof, showing two circular plates 28 and 40 (FIG. 2D(a) and FIG. 2D(b), identical to the circular plates illustrated in FIGS. 2C(a) and 2C(b), above), showing another embodiment for attaching the smaller plate (FIG. 2D(b)) to the larger plate (FIG. 2D(a)) by using machine screw 58 and now threaded hole 64 disposed in the center of plate 28, such that the two plates are rotatable with respect to each other by using the raised handle member 57. The two embodiments also permit plates 28 and 40 to have an adjustable resistance to relative rotation.

Figure 2E:
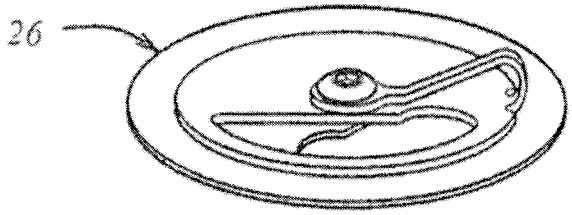
FIG. 2E is a schematic representation of a top perspective view of the members assembled into a disk-shaped lid.

FIG. 2E is a schematic representation of a top perspective view of flat circular plates 28 and 40 assembled into disk-shaped lid 26.

Figure 2F:
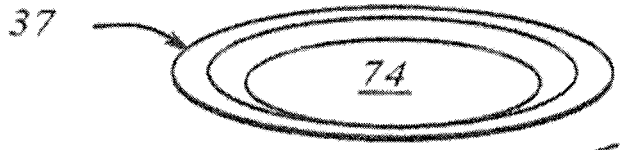
FIG. 2F is a schematic representation of a top perspective view of a circular, gasketed sealing lid for the jar.
Figure 2A:
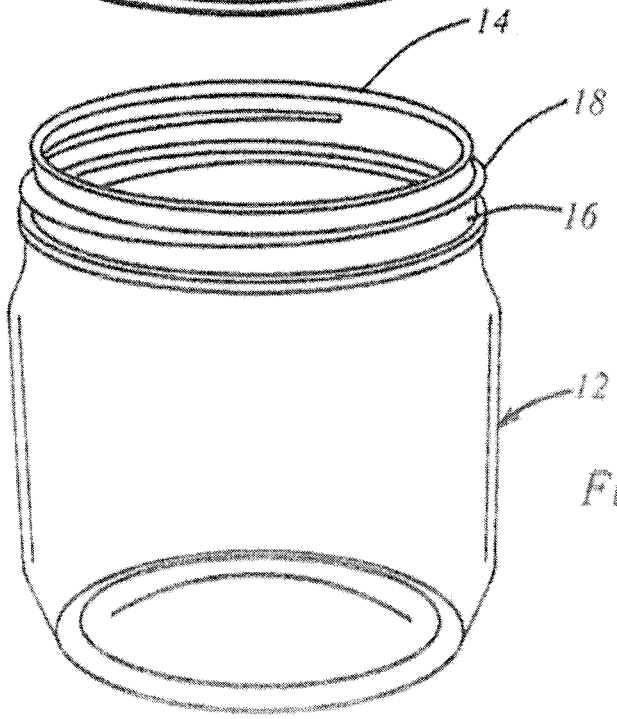
FIG. 2A is a is a schematic representation of a top perspective view of the jar portion of the container having a flat circular open mouth and a screw thread.
Figure 2C:
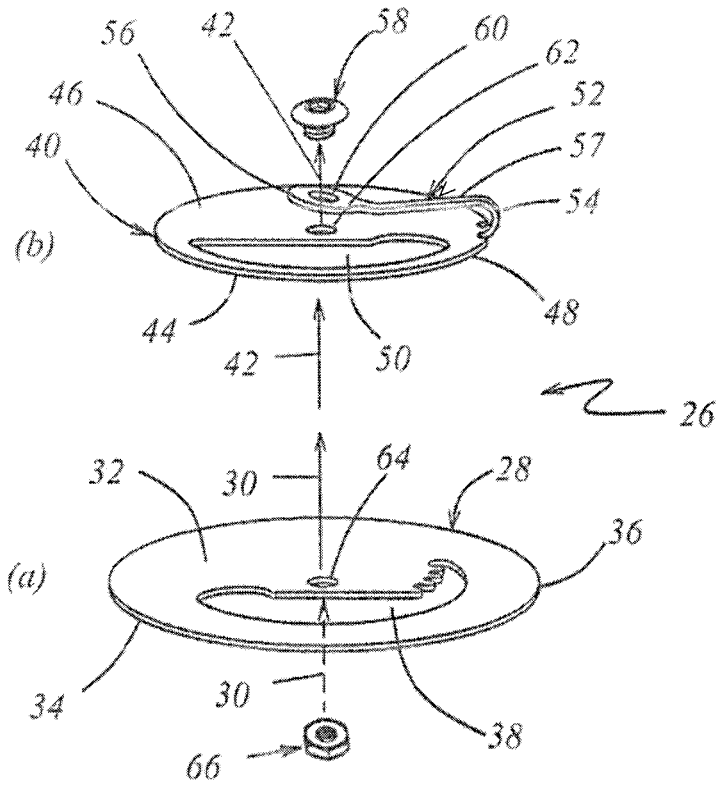
FIG. 2C is a schematic representation of a top perspective view of a disk-shaped lid having two disk-shaped members or plates (2C(a) and 2C(b)), which can be rotated relative to one another, the larger plate (2C(a)) being secured under the flat rim of the circular ring against the open mouth of the jar when circular gasketed sealing lid illustrated in FIG. 2F, below, is not in use, each plate having a chosen pattern therethrough, the smaller plate having a tension spring formed with or attached thereto and formed into a raised handle member, and a machine screw and nut illustrated in FIGS. 2C(b) and 2C(a), respectively, for attaching the smaller plate (2C(b)) to the larger member (2C(a)), such that the smaller plate is rotatable with respect to the larger member by using the raised handle member, whereby portions of the chosen patterns of the smaller plate can be made to partially overlap with or cover portions of the larger plate.
Figure 2D:
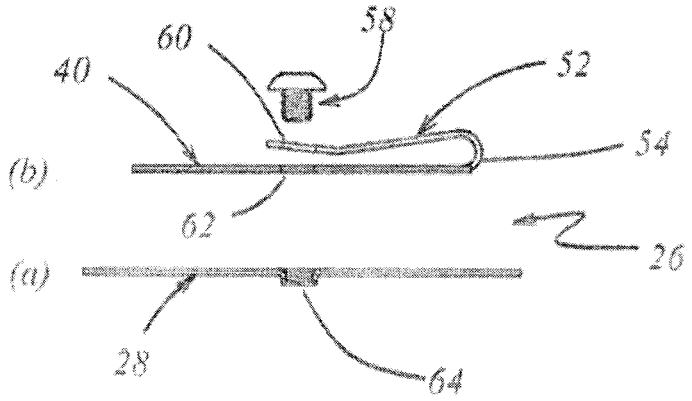
FIG. 2D is a schematic representation of a side view of the disk-shaped lid of FIG. 2C hereof showing two disk-shaped members or plates (FIG. 2D(a) and FIG. 2D(b), identical to the plates illustrated in FIGS. 2C(a) and 2C(b), above), showing another embodiment for attaching the smaller plate (FIG. 2D(b)) to the larger plate (FIG. 2D(a)) by using a machine screw and a threaded hole disposed in the center of the larger plate, such that the two plates are rotatable with respect to each other by using the raised handle member.
Figure 2G:
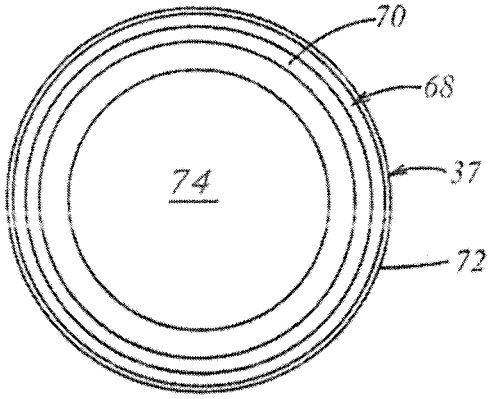
FIG. 2G is a schematic representation of a bottom view of the sealing lid, illustrating a flat gasket disposed on bottom surface thereof inside the circumference for forming an air-tight seal between the sealing lid and the flat circular open mouth of the jar.

FIG. 2F is a schematic representation of a top perspective view of a circular gasketed sealing lid 37 for jar 12, while FIG. 2G is a schematic representation of a bottom view of sealing lid 37 illustrating flat gasket, 68, attached to or otherwise disposed on bottom surface, 70, of sealing lid 37 inside circumference, 72, thereof for forming an air-tight seal between sealing lid 37 and the flat circular open mouth 14 of jar 12. Shown also is flat circular depression, 74. Sealing lid 37 may be used to protect the contents of container 10 from spoilage when on the shelf for sale, and/or for resealing container 10 after contents have been dispensed, if no further use is intended for a while, and deterioration thereof may otherwise occur.

Figure 3:
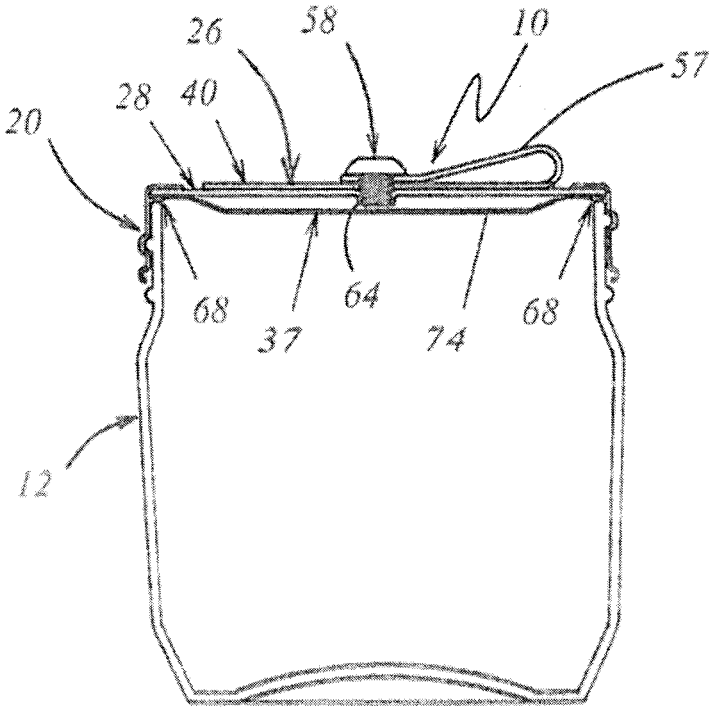
FIG. 3 is a schematic representation of a cutaway side view of the assembled container shown in FIG. 1 hereof, illustrating the circular depression in the sealing lid for providing space for the attachment nut for the two disk-shaped members.

FIG. 3 is a schematic representation of a cutaway side view of the assembled container shown in FIG. 1 hereof, illustrating circular depression 74 in sealing lid 37 for providing space for attachment nut 66 or threaded hole 64 for the two circular plates 28 and 40.

Figure 4B:
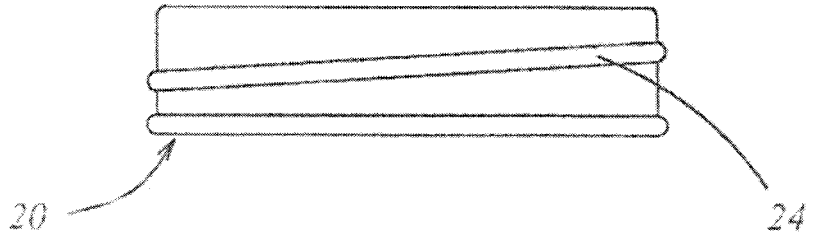
FIG. 4B is a schematic representation of a side view of the circular ring or band of FIG. 2B, hereof, showing the flat rim, and screw thread adapted to screw onto the screw thread of the jar member.
Figure 4C:
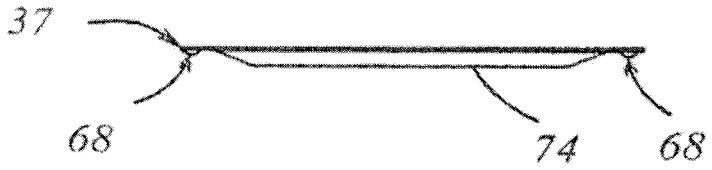
FIG. 4C is a schematic representation of a side view of the circular gasketed sealing lid for the jar shown in FIGS. 2F and 2G.
Figure 4A:
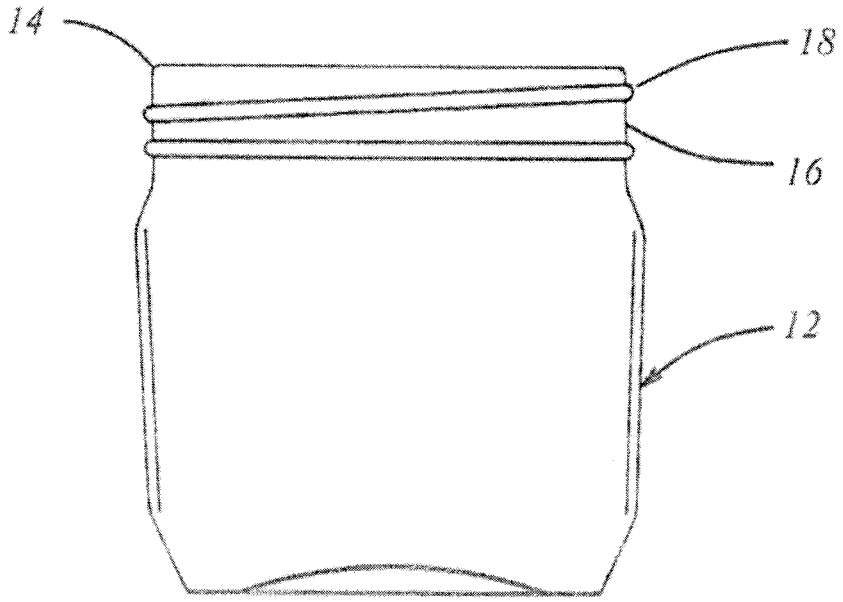
FIG. 4A is a schematic representation of a side perspective view of the jar member of FIG. 2A hereof showing the flat open mouth and the screw thread.
Figure 4D:
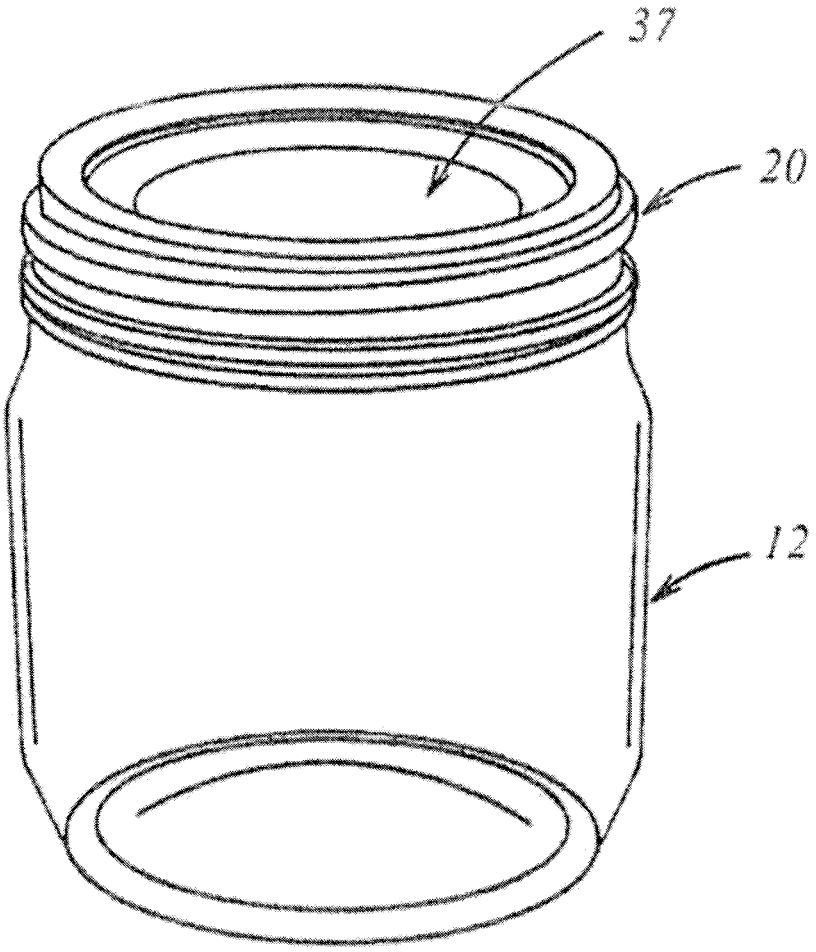
FIG. 4D is a schematic representation of a top perspective view of the elements shown in FIGS. 4A, 4B, and 4C as assembled to reseal the container.

FIG. 4A is a schematic representation of a side perspective view of jar member 12 illustrated in FIG. 2A, hereof, showing flat circular open mouth 14 and screw thread 18 in outer surface 16. FIG. 4B is a schematic representation of a side view of circular ring 20 illustrated in FIG. 2B, hereof, screw thread 24 adapted to screw onto screw thread 18 of the jar member 12. FIG. 4C is a schematic representation of a side view of circular gasketed sealing lid 37 for the jar shown in FIGS. 2F and 2G, hereof, and FIG. 4D is a schematic representation of a top perspective view of the elements shown in FIGS. 4A, 4B, and 4C, hereof, namely, 12, 20, and 37, respectively, as assembled to reseal the container.

Means for attaching second circular plate 40 to first circular plate 28 such that first surface 32 of first circular plate 28 is in rotatable contact with first surface 44 of second circular plate 40 about second axis 42, are described above, and illustrated in FIGS. 2C and 2D, and provide adjustable pressure between circular plate 28 and 40. Other means for achieving rotatable assembly include other threaded fasteners and rivets. As an example, in the situation where a rivet is employed, adjustable pressure may be achieved by appropriately bending tension spring or strip 52 after the plates are in rotatable contact.

Figure 5A:
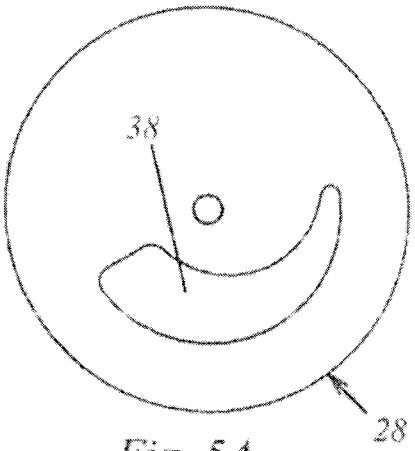
FIGS. 5A-5C are schematic representations of a top view of the larger circular plate shown in FIG. 2C(a), hereof, illustrating several patterns formed therethrough.
Figure 5D:
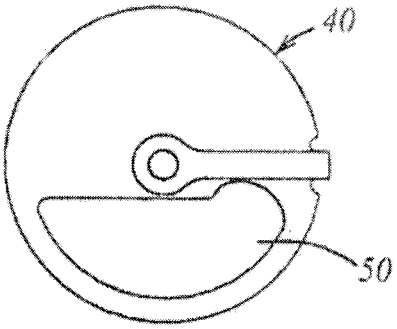
FIGS. 5D and 5E are schematic representations of a top view of the smaller circular plate shown in FIG. 2C hereof (FIG. 2C(b)), with FIG. 5D illustrating a pattern formed therethrough.
Figure 5B:
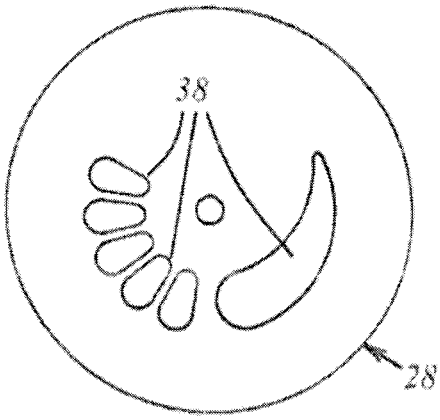
Figure 5E:
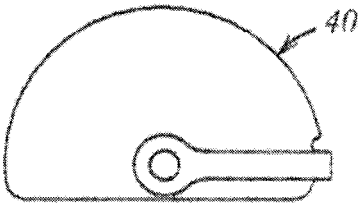
Figure 5C:
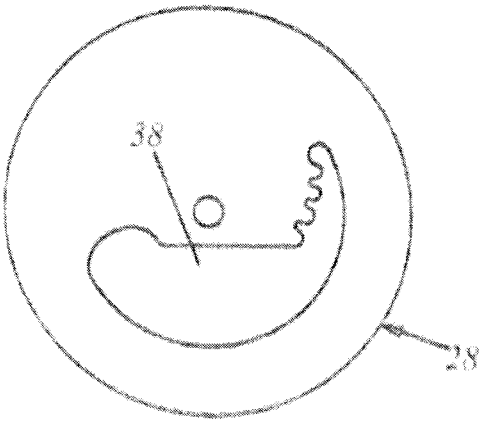

FIGS. 5A-5C are schematic representations of a top view of circular plate 28 shown in FIG. 2C(a), illustrating several patterns 38 formed therethrough, FIG. 5D is a schematic representation of a top view of circular plate 40 shown in FIG. 2C(b), hereof, illustrating pattern 50 formed therethrough, and FIG. 5E is a schematic representation of a top view of circular plate 40 shown in FIG. 2C(b) having a portion removed, as opposed to having a pattern formed therein, and represents one non-circular embodiment thereof. As stated, since circular plates 28 and 40 are rotatable with respect to one another, the portions of the chosen patterns illustrated in FIG. 2C and FIGS. 5A-5C of larger plate 28, can be made to be overlapped in part by, or be covered by portions of smaller plate 40.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A container having an adjustable opening, comprising:

a jar having a flat circular open mouth and an outer surface having a screw thread near the flat open mouth;

a circular ring having an open circular flat rim with a chosen inner diameter, and a screw thread adapted to screw onto the screw thread of said jar;

a disk-shaped lid, comprising:

a first circular flat plate having a first axis, a first surface and a second surface, an outer diameter such that said first circular plate is held between the flat open mouth of said jar and the flat rim of said ring, and a first chosen pattern formed therethrough inside the outer diameter thereof and outside of the first axis;

a second circular flat plate having a second axis colinear with the first axis of said first circular flat plate, a first surface and a second surface, a second outer diameter effective for permitting a portion of the first surface of said second circular flat plate to cover a portion of or all of the first chosen pattern of said first circular flat plate and smaller than the inner diameter of the flat rim of said circular lid, and a second chosen pattern formed therethrough inside the second outer diameter; and a tension spring having a first end and a second end, the first end thereof being formed with or attached to the second surface of said second circular flat plate and formed into a raised structure above the second surface; and means for attaching said second circular flat plate to said first circular flat plate such that the first surface of said first circular flat plate is in rotatable contact with the first surface of said second circular flat plate about the second axis, and said tension spring provides adjustable pressure between said second circular flat plate and said first circular flat plate and a handle for rotating said second circular plate.

2. The container of claim 1, wherein said jar comprises a Mason jar.

3. The container of claim 1, wherein said second circular flat plate is rotatable such that the first chosen pattern of said first circular flat plate and the second chosen pattern of said second circular flat plate, are caused to overlap forming an opening having a selected shape.

4. The container of claim 3, wherein the selected shape permits insertion of an implement into said jar.

5. The container of claim 1, wherein said first circular flat plate has a first hole therethrough along the first axis, said second circular flat plate has a second hole therethrough along the second axis, said tension spring has a hole therethrough in the vicinity of the second end thereof, and said means for attaching said second circular flat plate to said first circular flat plate comprises a machine screw having a threaded portion adapted to fit through the first hole through said first circular flat plate, the second hole through said second circular flat plate, and the hole in said tension spring; and a nut for screwing onto the threaded portion of said machine screw, such that pressure between said second circular flat plate and said first circular flat plate can be adjusted.

6. The container of claim 1, wherein said first circular flat plate has a first hole therethrough along the first axis, said second circular flat plate has a second hole therethrough along the second axis, the second hole having a threaded portion, said tension spring has a hole therethrough in the vicinity of the second end thereof, and said means for attaching said second circular flat plate to said first circular plate flat comprises a machine screw having a threaded portion adapted to fit through the first hole through said first circular plate and the hole in said tension spring, and adapted to screw into the threaded portion of the second hole; such that pressure between said second circular flat plate and said first circular flat plate can be adjusted.

7. The container of claim 1, wherein said circular ring, said first circular flat plate, said second circular flat plate, and said tension spring comprise metal.

8. The container of claim 1, further comprising a circular sealing lid having a first surface, a second surface, an outer diameter, and a flat gasket attached to or otherwise disposed on the second surface, said circular sealing lid being held between said first flat circular plate and the flat open mouth of said jar, and forming an air-tight seal with the flat circular open mouth of said jar.

9. A container having an adjustable opening, comprising:

a jar having a flat circular open mouth and an outer surface having a screw thread near the flat open mouth;

a circular ring having an open circular flat rim with a chosen inner diameter, and a screw thread adapted to screw onto the screw thread of said jar;

a disk-shaped lid, comprising:

a first circular flat plate having a first axis, a first surface and a second surface, an outer diameter such that said first circular flat plate is disposed adjacent to the flat rim of said ring, and a first chosen pattern formed therethrough inside the outer diameter thereof and outside of the first axis;

a second circular flat plate having a second axis colinear with the first axis of said first circular plate, a first surface and a second surface, a second outer diameter effective for permitting a portion of the first surface of said second circular flat plate to cover all or a portion of the first chosen pattern of said first circular flat plate and smaller than the inner diameter of the flat rim of said circular lid, and a second chosen pattern formed therethrough inside the second outer diameter; and a tension spring having a first end and a second end, the first end thereof being formed with or attached to the second surface of said second circular flat plate and formed into a raised structure above the second surface;

a circular sealing lid having a first surface, a second surface, a third outer diameter, and a flat gasket attached to or otherwise disposed on the second surface, said circular sealing lid being held between said first circular flat plate and the flat open mouth of said jar, forming an air-tight seal with the flat circular open mouth of said jar; and means for attaching said second circular flat plate to said first circular flat plate such that the first surface of said first circular flat plate is in rotatable contact with the first surface of said second circular flat plate about the second axis, and said tension spring provides adjustable pressure between said second circular flat plate and said first circular flat plate and a handle for rotating said second circular flat plate.

10. The container of claim 9, wherein said jar comprises a Mason jar.

11. The container of claim 9, wherein said second circular plate is rotatable such that the first chosen pattern of said first circular plate and the second chosen pattern of said second circular plate, are caused to overlap forming an opening having a selected shape.

12. The container of claim 11, wherein the selected shape permits insertion of an implement into said jar.

13. The container of claim 9, wherein said first circular plate has a first hole therethrough along the first axis, said second circular flat plate has a second hole therethrough along the second axis, said tension spring has a hole therethrough in the vicinity of the second end thereof, and said means for attaching said second circular flat plate to said first circular flat plate comprises a machine screw having a threaded portion adapted to fit through the first hole through said first circular flat plate, the second hole through said second circular flat plate, and the hole in said tension spring; and a nut for screwing onto the threaded portion of said machine screw, such that pressure between said second circular flat plate and said first circular flat plate can be adjusted.

14. The container of claim 9, wherein said first circular flat plate has a first hole therethrough along the first axis, said second circular flat plate has a second hole therethrough along the second axis, the second hole having a threaded portion, said tension spring has a hole therethrough in the vicinity of the second end thereof, and said means for attaching said second circular flat plate to said first circular flat plate comprises a machine screw having a threaded portion adapted to fit through the first hole through said first circular flat plate and the hole in said tension spring, and adapted to screw into the threaded portion of the second hole; such that pressure between said second circular flat plate and said first circular flat plate can be adjusted.

15. The container of claim 9, wherein said circular ring, said first flat circular plate, said second flat circular plate, said circular sealing lid, and said tension spring comprise metal.

16. A disk-shaped lid having an adjustable opening, comprising:

a first circular flat plate having a first axis, a first surface and a second surface, an outer diameter, and a first chosen pattern formed therethrough inside the outer diameter thereof and outside of the first axis;

a second flat plate having a first surface and a second surface for permitting a portion of the first surface of said second flat plate to cover all or a portion of the first chosen pattern of said first circular flat plate, and a second chosen pattern formed therethrough;

a tension spring having a first end and a second end, the first end thereof being formed with or attached to the second surface of said second flat plate and formed into a raised structure above the second surface; and means for attaching said second flat plate to said first circular flat plate such that the first surface of said first circular flat plate is in rotatable contact with the first surface of said second flat plate, and said tension spring provides adjustable pressure between said second flat plate and said first circular flat plate, and a handle for rotating said second flat plate.

17. The disk-shaped lid of claim 16, wherein said second flat plate comprises a circular flat plate having a second axis colinear with the first axis of said first circular plate, a second outer diameter effective for permitting a portion of the first surface of said second circular flat plate to cover all or a portion of the first chosen pattern of said first circular flat plate, and a second chosen pattern formed therethrough inside the second outer diameter.

18. The disk-shaped lid of claim 17, wherein said second circular flat plate is rotatable such that the first chosen pattern of said first circular flat plate and the second chosen pattern of said second circular flat plate, are caused to overlap forming an opening having a selected shape.

19. The disk-shaped lid of claim 17, wherein said first circular flat plate has a first hole therethrough along the first axis, said second circular flat plate has a second hole therethrough, said tension spring has a hole therethrough in the vicinity of the second end thereof, and said means for attaching said second circular flat plate to said first circular flat plate comprises a machine screw having a threaded portion adapted to fit through the first hole through said first circular flat plate, the second hole through said second circular flat plate, and the hole in said tension spring; and a nut for screwing onto the threaded portion of said machine screw, such that pressure between said second circular flat plate and said first circular flat plate can be adjusted.

20. The disk-shaped lid of claim 17, wherein said first circular flat plate has a first hole therethrough along the first axis, said second circular flat plate has a second hole therethrough, the second hole having a threaded portion, said tension spring has a hole therethrough in the vicinity of the second end thereof, and said means for attaching said second circular flat plate to said first circular flat plate comprises a machine screw having a threaded portion adapted to fit through the first hole through said first circular flat plate and the hole in said tension spring, and adapted to screw into the threaded portion of the second hole; such that pressure between said second circular flat plate and said first circular flat plate can be adjusted.

21. The disk-shaped lid of claim 17, wherein said first circular flat plate, said second circular flat plate, and said tension spring comprise metal.

22. The disk-shaped lid of claim 16, wherein said means for attaching said second flat plate to said first circular flat plate such that the first surface of said first circular flat plate is in rotatable contact with the first surface of said second flat plate are chosen from threaded fasteners and rivets.

* * * * *